US010711641B2

(12) United States Patent
Giachetti et al.

(10) Patent No.: US 10,711,641 B2
(45) Date of Patent: Jul. 14, 2020

(54) COMPRESSOR WITH A THERMAL SHIELD AND METHODS OF OPERATION

(71) Applicant: NUOVO PIGNONE S.R.L., Florence (IT)

(72) Inventors: Silvio Giachetti, Florence (IT); Massimiliano Borghetti, Florence (IT); Luca Lombardi, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 1069 days.

(21) Appl. No.: 14/892,593

(22) PCT Filed: May 19, 2014

(86) PCT No.: PCT/EP2014/060267

§ 371 (c)(1),
(2) Date: Nov. 20, 2015

(87) PCT Pub. No.: WO2014/187786

PCT Pub. Date: Nov. 27, 2014

(65) Prior Publication Data

US 2016/0084110 A1 Mar. 24, 2016

(30) Foreign Application Priority Data

May 21, 2013 (IT) ..... FI2013A0118

(51) Int. Cl.
*F01D 25/14* (2006.01)
*F04D 29/58* (2006.01)

(52) U.S. Cl.
CPC ..... *F01D 25/145* (2013.01); *F04D 29/5853* (2013.01)

(58) Field of Classification Search
CPC . F01D 25/145; F04D 29/5853; F04D 29/5893
See application file for complete search history.

(56) References Cited

U.S. PATENT DOCUMENTS 626,673 A 6/1899 Cox
4,694,654 A 9/1987 Kawamura
(Continued)

FOREIGN PATENT DOCUMENTS

CN 102575576 A 7/2012
CN 102734172 A 10/2012
(Continued)

OTHER PUBLICATIONS

Italian Search Report and Opinion issued in connection with corresponding IT Application No. FI2013A000118 dated Jan. 27, 2014.
(Continued)

*Primary Examiner* — Justin D Seabe
*Assistant Examiner* — Cameron A Corday
(74) *Attorney, Agent, or Firm* — Baker Hughes Patent Organization

(57) ABSTRACT

A compressor includes a compressor bundle and an outer casing. Between the outer casing and the compressor bundle a thermal shield is provided, for reducing thermal stress and visco-plastic deformation of the casing under severe operating conditions.

15 Claims, 6 Drawing Sheets

(56) References Cited

U.S. PATENT DOCUMENTS

| | | | | |
|---|---|---|---|---|
| 4,762,462 | A * | 8/1988 | Lardellier | F01D 9/041 415/139 |
| 5,630,702 | A | 5/1997 | Marmilic et al. | |
| 5,709,100 | A | 1/1998 | Baer et al. | |
| 6,918,745 | B2 | 7/2005 | Caron et al. | |
| 2003/0177780 | A1 | 9/2003 | Brutscher et al. | |
| 2009/0041578 | A1* | 2/2009 | Haje | F01D 5/28 415/177 |
| 2011/0262284 | A1 | 10/2011 | Guernard | |
| 2011/0314847 | A1* | 12/2011 | Ding | F04D 25/16 62/115 |

FOREIGN PATENT DOCUMENTS

| | | | |
|---|---|---|---|
| DE | 427425 | C | 4/1926 |
| EP | 0713977 | A2 | 5/1996 |
| GB | 2115487 | A | 9/1983 |
| JP | S60-95124 | A | 5/1985 |
| JP | S61-244805 | A | 10/1986 |
| JP | 2001-107873 | A | 4/2001 |
| JP | 2004-522891 | A | 7/2004 |
| RU | 2 234 003 | C1 | 8/2004 |
| SU | 926371 | A1 | 5/1982 |

OTHER PUBLICATIONS

PCT Invitation to pay additional fee issued in connection with corresponding PCT Application No. PCT/EP2014/060267 dated Sep. 26, 2014.

PCT Search Report and Written Opinion issued in connection with corresponding PCT Application No. PCT/EP2014/060267 dated Feb. 17, 2015.

First Office Action and Search issued in connection with corresponding CN Application No. 201480029555.7 dated May 2, 2017.

Office Action and Search issued in connection with corresponding RU Application No. 2015149337 dated Mar. 28, 2018.

Machine Translation and Notification of reasons for refusal issued in connection with corresponding Application No. 2016-514361 dated Apr. 3, 2018.

Decision to Grant issued in connection with corresponding RU Application No. 2015149337 dated Aug. 6, 2018.

* cited by examiner

STATE OF THE ART

COMPRESSOR WITH A THERMAL SHIELD AND METHODS OF OPERATION

TECHNICAL FIELD

The subject matter disclosed herein relates to gas compressors, in particular to multistage gas compressors, such as centrifugal multistage gas compressors.

BACKGROUND

Gas compressors are used in a plurality of industrial applications to boost the pressure of a gas, for example for pipeline applications, in the oil and gas industry, in carbon dioxide recovery plants, in compressed air energy storage systems and the like.

The gas processed by the compressor is ingested at an inlet pressure and delivered at a higher outlet pressure, the pressure increase being obtained by conversion of mechanical power into potential pressure energy stored in the gas flow. The process provokes a temperature increase of the processed gas. In some applications the gas temperature can increase to several hundreds of degrees Celsius.

Typical applications where high pressure and high temperature values are achieved by the processed gas are those relating to compressed air energy storage in so-called CAES systems. These systems are used to accumulate energy in form of pressure energy in an air storage cavern, exploiting excess electric power available on the electric distribution grid for example at night time. Typically, multistage gas compressors are used in CAES systems to achieve the required outlet air pressure.

FIG. 1 illustrates a longitudinal section of a multistage centrifugal compressor 100 of the current art. The compressor comprises an outer casing 101, wherein a rotor 103 is housed. The rotor 103 is comprised of a shaft 105 and a plurality of impellers 107. In the example shown in FIG. 1 the multistage centrifugal compressor 100 comprises five impellers sequentially arranged in a flow direction from a compressor inlet 109 to a compressor outlet 111. The shaft 105 is supported by bearings 113, 115.

Each impeller forms part of a respective compressor stage which comprises an inlet channel 117 and a return channel 119. Gas processed by each impeller 107 enters the impeller at the inlet 117 and is returned by the return channel 119 towards the inlet 117 of the next impeller. The return channel of the various compressor stages are formed by one or more diaphragms 121, which are stationarily housed in the casing 101. The gas discharged from the last impeller, i.e. from the most downstream impeller, is collected by a volute 123, wherefrom the compressed gas is conveyed to the gas outlet 111.

The casing 101 can be comprised of a barrel 101B and two end portions 101C, forming a closed housing where the rotor 103 is rotatingly arranged and the diaphragms 121 are stationarily housed.

Mechanical power is used to rotate impellers 107 and is transformed into gas pressure, the pressure increasing gradually as the gas flows through the sequentially arranged impellers. The compression process generates heat so that the gas temperature increases from an inlet temperature to an outlet temperature. The heat is transferred from the gas to the diaphragms 121 and therefrom to the casing 101. The casing 101 therefore is heated up to a maximum steady state temperature, which depends upon the compression ratio of the compressor 100, from the compressor efficiency and from the environment temperature.

SUMMARY OF THE INVENTION

According to some embodiments, a gas compressor is provided, comprising a compressor casing and a compressor bundle arranged in the compressor casing. A thermal shield is arranged between the compressor casing and the compressor bundle. The thermal shield arrangement reduces or slows down the thermal transfer from the compressor bundle towards the compressor casing. This results in a slower heating up of the casing and also reduces the steady state temperature reached by the outer casing under continuous operating conditions of the compressor in case of natural or forced ventilation. The casing is thus subject to reduced thermo-mechanical stresses and visco-plastic deformation (or creep deformation) is prevented or retarded.

The compressor bundle can comprise a rotor comprised of at least one impeller mounted thereon and at least one diaphragm arranged stationarily in the compressor casing. In a multistage compressor, the bundle comprises a rotor with a plurality of impellers and a diaphragm or a plurality of diaphragms forming return channels between subsequent impellers. A volute can be stationarily arranged in the casing, for collecting the compressed gas from the last compressor stage and conveying the compressed gas towards the gas outlet of the compressor.

According to some embodiments the compressor can be operated for an operative time intervals, separated by cooling intervals, during which the compressor is inoperative and is allowed to cool down. The thermal shield arrangement slows the heat exchange rate between the compressor bundle and the casing, and thus increases the allowable duration of the operative time intervals.

The compressor bundle can comprise a compressor rotor and one or more diaphragms. In some embodiments the compressor is a centrifugal compressor. In some embodiments the compressor is a multistage compressor, comprising a plurality of impellers mounted for rotation in one or more diaphragms, which are stationarily arranged in the casing.

The thermal shield arrangement can comprise a continuous or discontinuous thermal barrier arranged between the diaphragm(s) and the inner surface of the outer casing. In some embodiments, the thermal shield arrangement can include a thermal barrier arranged along a volute collecting the compressed gas from the last compressor stage and wherefrom the compressed gas is conveyed towards the compressor outlet.

The compressor outlet can comprise an outlet duct, forming part of the outer casing, or connected thereto. In some embodiments, an inner thermal barrier is provided between the gas passageway and the inner surface of the outlet duct. The thermal barrier limits the heat transmission from the gas flow to the gas outlet duct. The thermal barrier can comprise a thermal cladding and an inner liner, the thermal cladding being arranged between the inner surface of the outlet duct and the gas flow pathway, so that direct contact between the cladding and the gas is prevented.

According to a further aspect, the subject matter disclosed herein relates to a compressor system comprising at least a first compressor and a second compressor, each more particularly provided with a thermal shield arrangement between the compressor bundle and the casing. The at least two compressors are used alternatively, so that while one compressor processes a gas and heats up, the other compressor is resting and can cool down. Switching from one compressor to the other results in a continuous gas processing, with an intermittent operation of each compressor, so that each compressor of the system can cool down once the casing thereof has reached a threshold temperature and/or once the compressor has operated for a predetermined time interval.

Degradation of mechanical properties due to high temperature and creep damages of the outer casing are thus effectively prevented even if less performing material, such as low alloy steel, is used for the manufacturing of the outer casing.

According to yet a further aspect, the subject matter disclosed herein concerns a method of operating a gas compressor, comprising a compressor casing and a compressor bundle in the casing, the method comprising the step of reducing heat transfer from a gaseous flow processed by the compressor towards the casing.

According to an still further aspect, the subject matter of the present disclosure concerns a method of operating a compressor system, the compressor system comprising a first compressor and a second compressor, the first compressor and the second compressor being provided with a thermal shield between the respective compressor casing and compressor bundle, the method including the following steps running one of the first compressor and second compressor while maintaining the other of the first compressor and second compressor inoperative, after a time interval, operating the other of the first compressor and second compressor, stopping the one of the first compressor and second compressor and allowing the one compressor to cool.

In addition to the advantages in terms of reduction of the thermal-mechanical stress on the outer casing, the use of a thermal shield preventing or reducing the heat flow from the gas flow and the compressor bundle towards the compressor casing has the further advantage of preventing or reducing the heat dissipation from the process gas. The gas delivered by the compressor has thus an increased energy content in the form of thermal energy, which can be usefully exploited. For example, in CAES systems the higher temperature of the compressed air collected in the compressed-air container increases the overall efficiency of the system, when the air is expanded to produce mechanical power. In other embodiments, thermal energy can be extracted from the compressed gas flow and used or stored in a heat storage sink to be used in a separate process.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
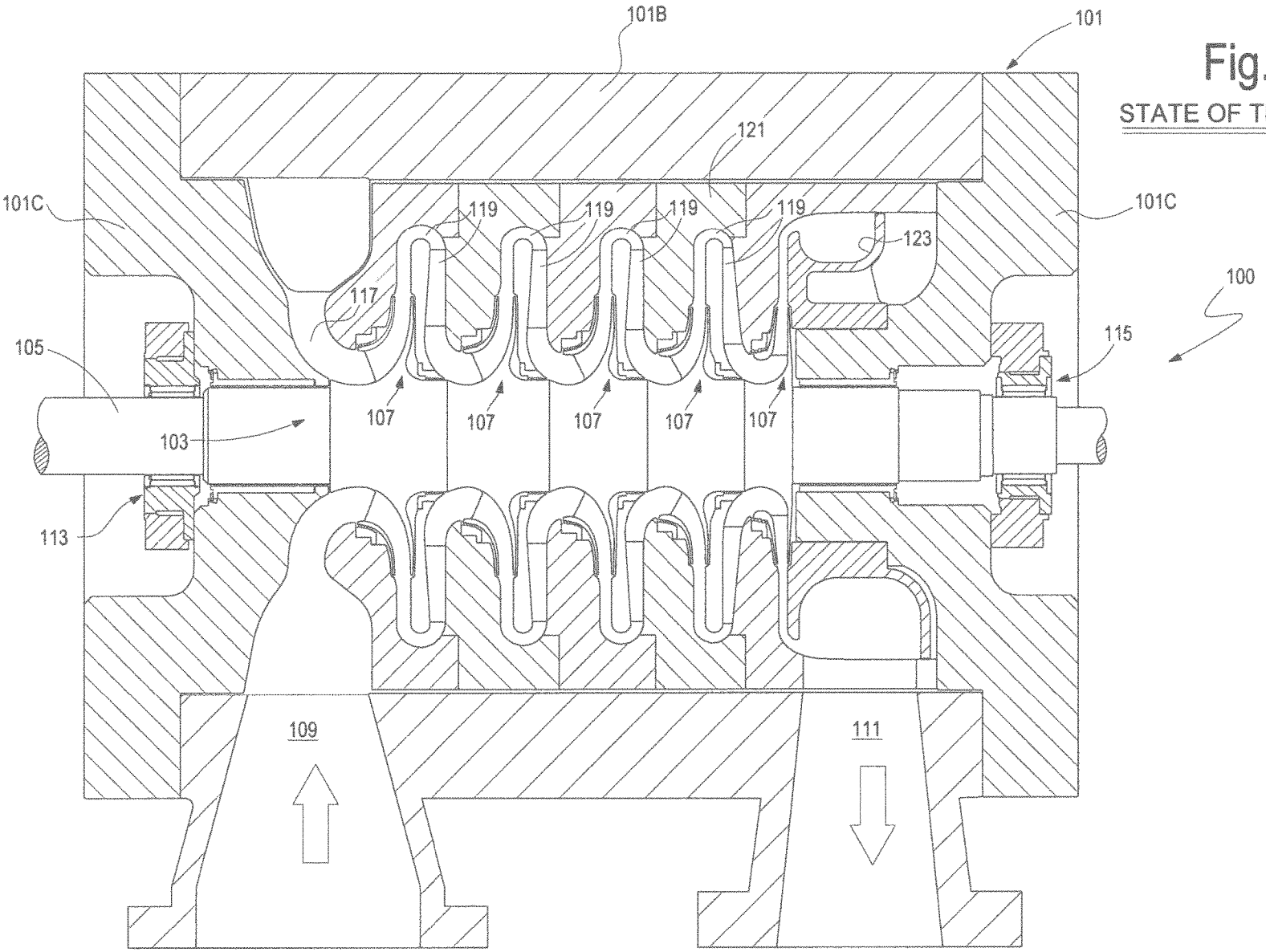
FIG. 1 illustrates a sectional view of a multistage centrifugal compressor of the current art.
Figure 2:
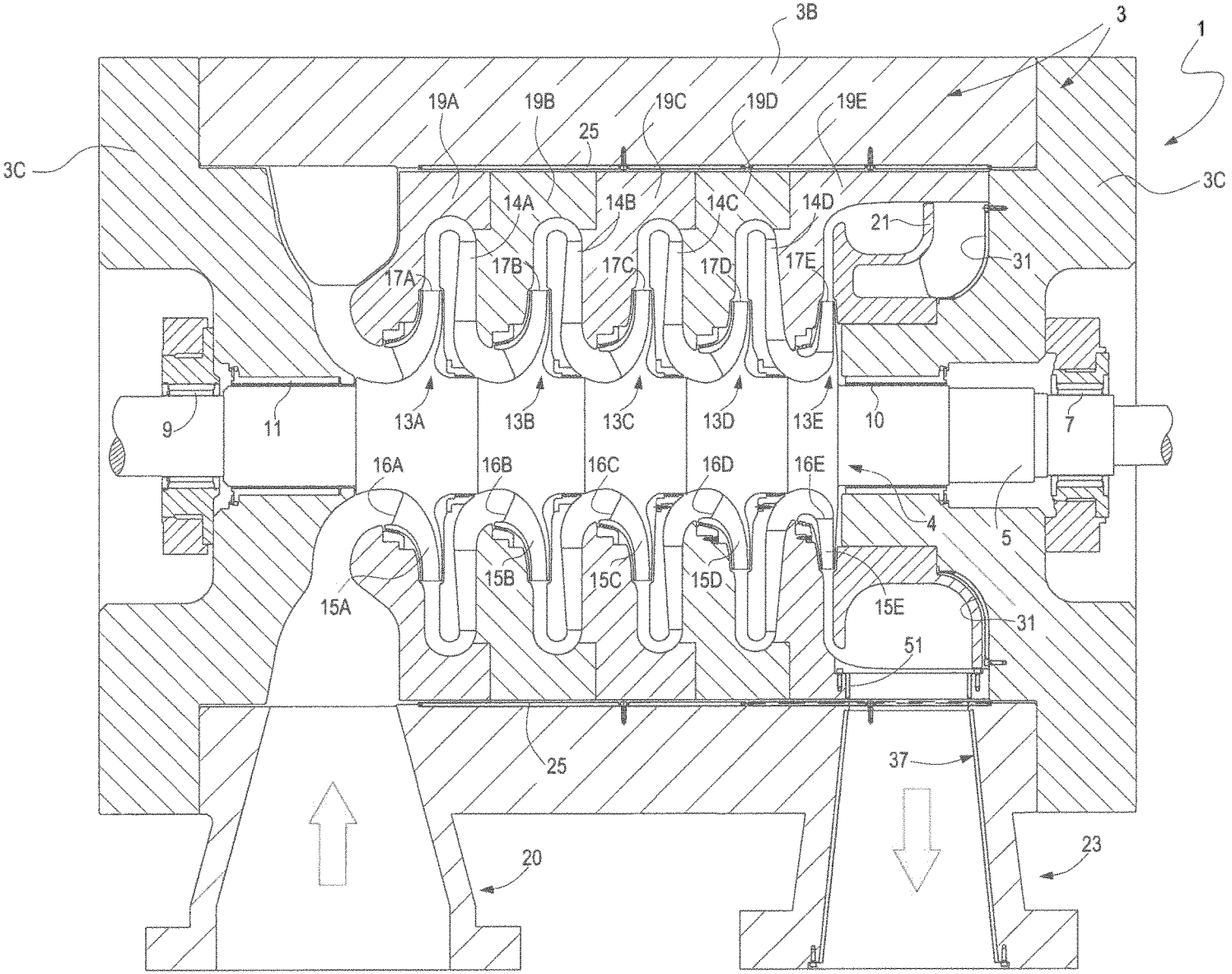
FIG. 2 illustrates a sectional view of a multistage centrifugal compressor according to the present disclosure in one embodiment.

FIG. 2 illustrates a sectional view of a multistage centrifugal compressor 1 according to the present disclosure. The multistage centrifugal compressor 1 comprises a casing 3 wherein a rotor 4 is rotatingly supported.

In some embodiments the casing 3 comprises an external cylindrical barrel 3B and two end covers 3C. This arrangement is typical of so-called vertically split compressors. In other embodiments the casing 3 can be comprised of two substantially symmetrical half casing portions which match one with the other along an axial longitudinal plane. The second kind of casing is used in so-called horizontally split compressors. The subject matter disclosed herein can be embodied in both kinds of compressors, even though the drawings show just one exemplary embodiment relating to a horizontally split multistage centrifugal compressor.

The rotor 4 can be comprised of a rotor shaft 5 supported by bearings 7 and 9. Seals 10 and 11 can be provided to isolate the interior of the compressor 1 from the environment.

In some embodiments one or more impellers can be mounted on the shaft 5. In the exemplary embodiment of FIG. 2 the compressor 1 is a multistage centrifugal compressor comprising five compressor stages, each comprised of a respective impeller. The impellers are indicated 13A, 13B, 13C, 13D, and 13E and will be referred cumulatively also as impellers 13.

In some embodiments the impellers 13 can be keyed on the rotor shaft as shown in FIG. 2. Other structures are, however, possible. In some embodiments the rotor 4 can be comprised of stacked impellers 13 hold together by a central tie rod, as disclosed for instance in US2011/0262284, which is incorporated herein by reference.

Each impeller 13A-13E is comprised of a plurality of impeller vanes 15A-15E, formed by impeller blades having respective leading edges 16A-16E and trailing edges 17A-17E. Each impeller 13A-13D is combined with a return channel 14A, 14B, 14C and 14D respectively, formed in respective diaphragms 19A-19D, stationarily housed in the casing 3. In some embodiments, the diaphragms can be monolithic rather than formed by separate and stacked components, as shown in the exemplary embodiment of FIG. 2.

The diaphragms 19 and the rotor 4 form part of a so-called compressor bundle, which is housed in the compressor casing 3.

The gas enters the compressor 1 through a gas inlet 20 and is delivered sequentially through the impellers 13A-13E.

The gas is processed by each impeller 13 and enters the vanes 15 at the impeller inlet, defined by the blade leading edges 16, and exits the impeller at the outlet thereof corresponding to the blade trailing edges 17. The gas processed by each impeller 13A-13D is returned by the respective return channel 14A-14D radially from the outlet towards the inlet of the subsequent impeller 13.

Gas exiting the last impeller 13E is collected in a volute 21 and discharged through a gas outlet 23.

The gas flowing through the compressor stages is gradually compressed from an inlet pressure to an outlet pressure. Gas compression provokes also a temperature increase, as part of the mechanical energy delivered by the impellers to the gas is converted into thermal energy. Heat tends to flow from the rotor 4 and the diaphragms 19 towards the casing 3, which is gradually heated.

The outer casing 3 is thus subject to high thermal and mechanical stress, due to the pressure inside the casing, corresponding to the discharge pressure of the processed gas. The combined effect of temperature and pressure can lead to visco-plastic deformations (creep deformation) of the casing 3, especially if the casing temperature increases beyond a critical temperature threshold.

To limit the temperature achieved by the outer casing 3 during operation of the compressor 1, and therefore reducing thermal stress thereof, and/or in order to use less performing material for manufacturing the casing 3, according to some embodiments a thermal shielding arrangement is provided, which reduces the heat transfer from the diaphragms 19 towards the casing 3. The thermal shielding arrangement reduces the heating rate of the casing and also reduces the final steady-state temperature achieved by the casing under continuous compressor operation. Consequently, the thermal shielding arrangement also increases the final temperature of the gas delivered by the compressor 1.

According to some embodiments, the thermal shielding arrangement comprises a thermal shield 25 arranged along the inner surface of the central portion of the casing 3, surrounding the diaphragms 19.

In some embodiments, as shown in FIG. 2, the thermal shield 25 is arranged along the substantially cylindrical inner surface of barrel 3B.

Figure 3:
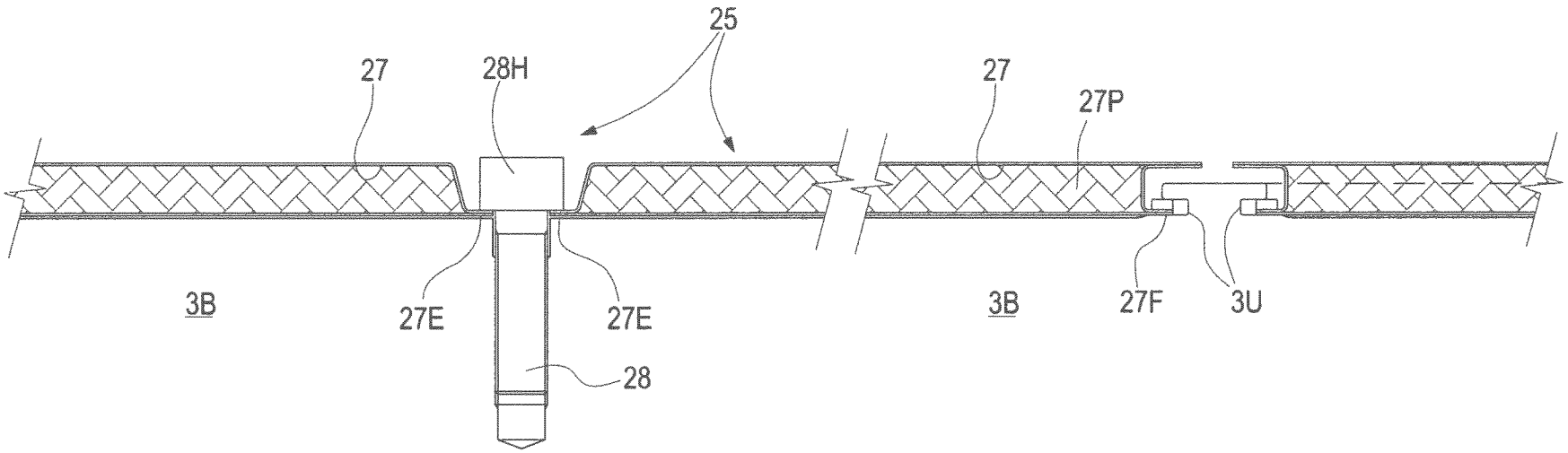
FIG. 3 illustrates an enlargement of a portion of the thermal shield between the diaphragms and the outer casing of the compressor of FIG. 2.

FIG. 3 illustrates an enlargement of the thermal shield 25. In some embodiments the thermal shield 25 can comprise shielding panels 27. The shielding panels 27 can be attached to the outer casing 3, more particularly in thermal contact therewith. Connection members 28 are provided to attach the shielding panels 27 to the casing 3. In some embodiments the connection members 28 can comprise screws with respective heads 28H, which lock edges 27E of adjacent shielding panels 27 to the casing 3.

In some embodiments, as shown in FIG. 3, each shielding panel 27 can be connected to the casing 3 along opposite edges 27E and 27F, one edge 27E being engaged by a respective set of screws 28 and the opposing parallel edge 27F being engaged in an undercut 3U formed along the inner surface of the casing 3. The undercut 3U and the shielding panels 27 are dimensioned so that sufficient clearance remains between the edges 27F and the seat forming the undercut 3U to allow thermal expansion of the shielding panels 27.

In some embodiments the shielding panels can be comprised of an outer sheet, e.g. a metal plate or sheet 27M. For instance, the metal plate or sheet 27M can be made of steel. The metal sheet 27M is shaped so as to form an inner pocket 27P, which can be filled with a thermally isolating material, for example a ceramic powder or ceramic fibers. According to some exemplary embodiments, insulating materials such as steatite, cordierite, alumina, zirconia or mixtures thereof can be used. Other insulating materials can be used depending upon the degree of insulation required.

According to other embodiments rather than in the form of shielding panels, the thermal shield can be provided in the form of a coating to be directly applied on the inner surface of the casing. According to some exemplary embodiments, the coating can be applied by thermal spray, plasma spray, electro-chemical deposition.

As can best be seen in FIG. 2, the thermal shielding arrangement including the thermal shield 25 surrounds substantially the entire diaphragms arrangement 19, thus limiting the thermal flux from the gas path towards the outer casing 3.

In some embodiments, additional thermally isolating arrangements are provided in other parts of the compressor 1. In some embodiments, a further thermal shield 31 is arranged around the volute 21, as shown in FIG. 2 and in the enlargement of FIG. 4. In some embodiments the thermal shield 31 can be comprised of one or more shaped metal sheets or plates 31M forming an inner pocket 31P, which can be filled with a thermally isolating material, such as ceramic powder, or other material as set forth above in connection with the shielding panels 27.

In some embodiments the thermal shield 31 can be attached to the outer casing 3, for example to the respective end cover 3E thereof, by means of connection members 33, for example screws or the like. In a vertically split compressor as illustrated in FIG. 2, the thermal shield 31 can formed monolithically as a single component. In other embodiments, the thermal shield 31 can be split into a plurality of separate components. For example, in a horizontally split compressor, the thermal shield 31 can be comprised of two semi-annular portions, mounted in the two half-casing portions forming the outer compressor casing. The thermal shield 31 limits the heat flow from the volute 21 towards the outer casing 3.

In some embodiments, additional thermal insulation arrangements can be provided to reduce the thermal flow from the pressurized gas towards the outer casing of the turbocompressor 1 at the outlet 23 thereof.

Figure 4:
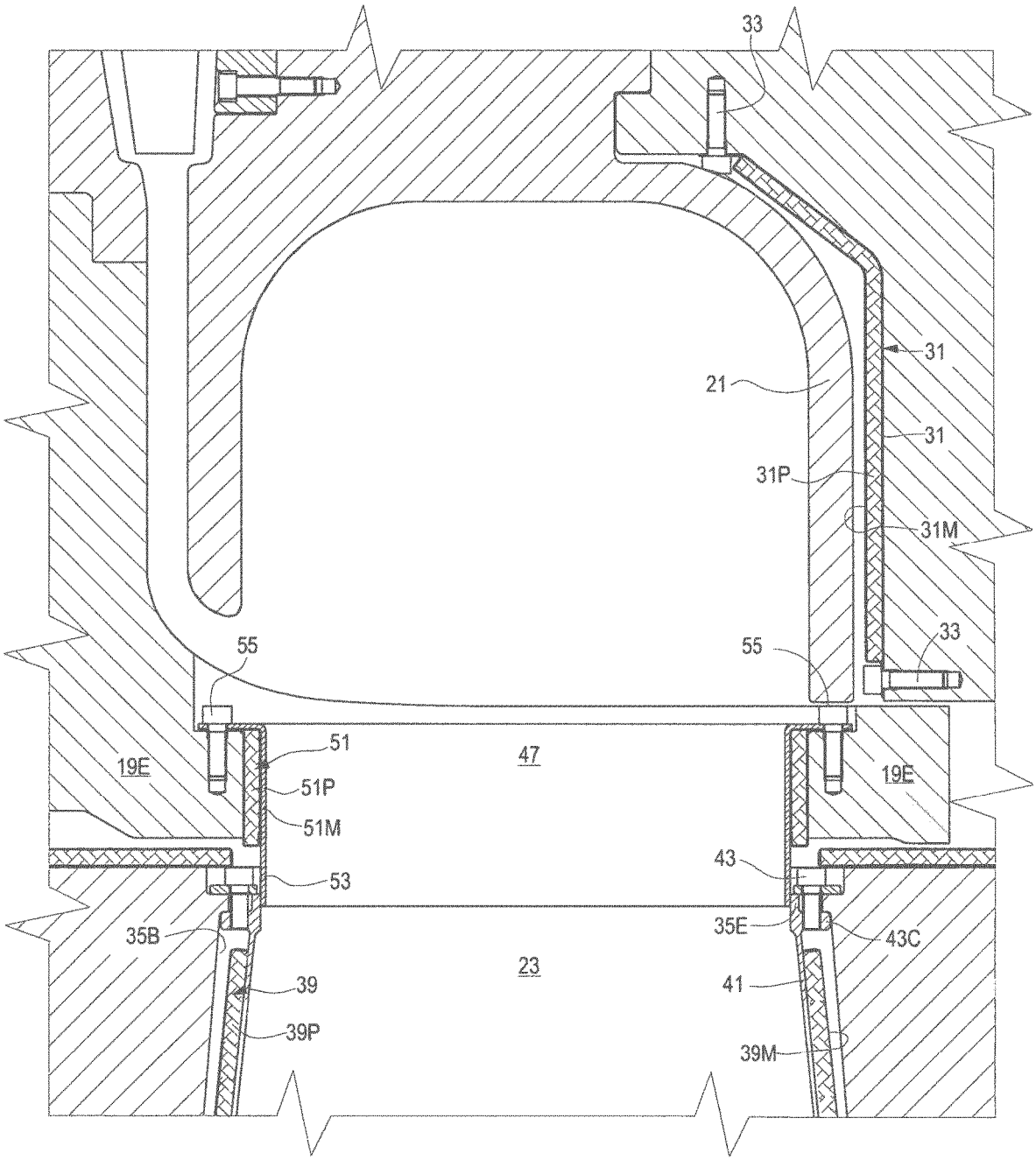
FIG. 4 illustrates an enlargement of a thermal shield arranged around the volute of the compressor shown in FIG. 2.
Figure 5:
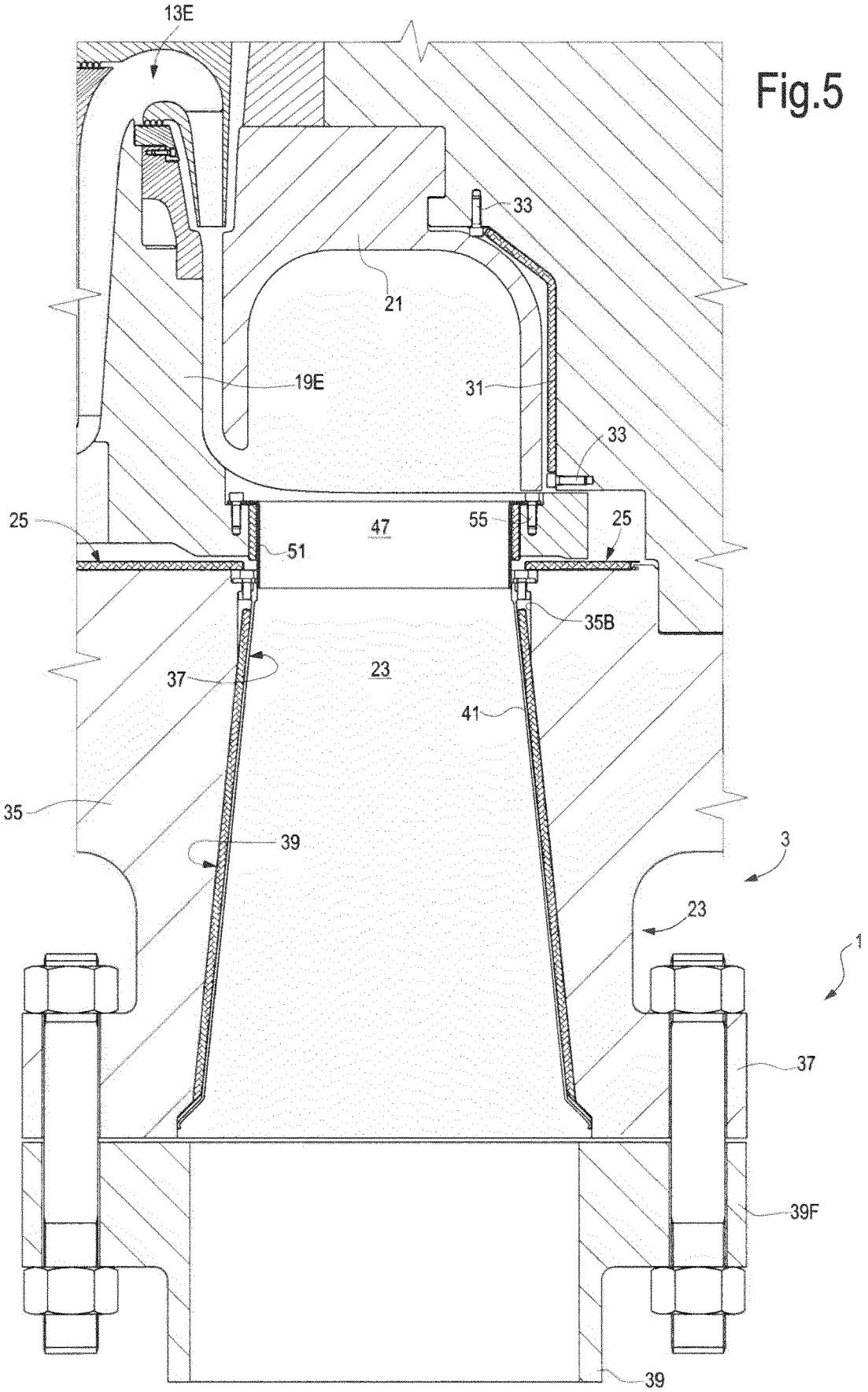
FIG. 5 illustrates an enlargement of a thermal cladding arranged in the outlet duct of the compressor of FIG. 2.

In some embodiments, as best shown in FIGS. 4 and 5, the gas outlet 23 of compressor 1 can comprise a discharge duct 35 which can be provided with a flange 37 connecting the gas outlet to an outlet piping 39 having a respective flange 39F.

The discharge duct 35 can have an inner frustum-conical surface 35B, along which a thermal insulating arrangement 37 is provided. The thermal insulating arrangement 37 can be comprised of a thermally insulating cladding 39. In some embodiments a liner 41 can further be provided, as shown in FIGS. 4 and 5.

The liner 41 can be arranged between the process fluid and the thermally insulating cladding 39. Such liner 41 can be provided for the purpose of protecting the thermally insulating cladding 39 from the action of the fluid processed by the compressor. In some application the process fluid can contain an amount of dirt or other chemically or mechanically aggressive components or materials that could erode the thermally insulating cladding 39 if a protective liner were not provided.

The thermal insulating cladding 39 can be in the form of a frustum-conical member, which can be made of folded metal sheet 39M, surrounding an inner pocket 39P, which can be filled with a thermally isolating material, such as ceramic or the like, similarly to the above described thermal shield arrangements surrounding the diaphragms 19 and the volute 21.

The thermal insulating cladding 39 can be arranged between the inner surface 35B of the discharge duct 35 and the inner liner. As best shown in FIG. 4, the inner liner 41 can be attached for example by means of screws 43 to the discharge duct 35 or to any other stationary portion of the casing 3.

The liner 41 can be frustum-conically shaped and can be provided with an outer annular collar 43C having a plurality of threaded holes wherein the screws 43 are screwed, the annular collar 43C abutting against an annular edge 35E of the discharge duct 35.

An additional thermal shielding can be provided along a flow passage 47 between the volute 21 and the gas outlet 23, as shown in FIGS. 4 and 5. This additional thermal shielding can be comprised of a thermal cladding 51 arranged between an inner surface of a through aperture, which is provided in the most downstream diaphragm 19E, and a liner 53. The thermal cladding 51 can be comprised of a metal sheet 51M, for example a steel sheet or plate, folded to form an inner pocket 51P, which can be filled with thermally isolating material, such as ceramic or other materials as set forth above. The thermal cladding 51 and the liner 53 can be attached to the diaphragm 19E by means of screws 55 or other connection members. According to other embodiments, rather than in the form of shielding panels attached to the stationary components of the compressor, the thermal cladding 39 can be provided in the form of a coating to be directly applied on the inner surface of the discharge duct 35. For example a coating can be applied on the inner surface of the discharge duct 35 by thermal spray, plasma spray, electro-chemical deposition. A protective liner 41 can be provided to protect the coating from chemical or mechanical action by the processed gas.

Similarly, in some embodiments, the thermal insulation between the volute 21 and the outer casing can be provided in the form of a thermally insulation coating, rather than in the form of shielding panels. The coating can be applied on the outer surface of the volute 21 and/or on the inner surface of a portion of the casing, e.g. the end cover 3C.

The thermal shield arrangement described so far provides an efficient thermal barrier between the bundle, i.e. rotor 4 and diaphragms 19, and the outer casing 3. The thermal barrier reduces the heating rate of the casing. The thermal barrier can also reduce the steady state temperature achieved by the outer casing 3 while the compressor 1 is operating. Both effects reduce the risk of visco-plastic deformations (creep deformation) of the outer casing 3, so that less performing material can be used for the manufacturing of such casing even where high temperatures and pressure of the processed gas are reached during operation. The use of less performing material reduces the cost of the compressor and makes machining easier.

In some embodiments, the compressor 1 can be operated so that it will be stopped when the casing 3 achieves a temperature which can be dangerous in view of possible casing failures due to creep. Using the thermal barrier formed by one or more of the thermal shield arrangements disclosed above reduces the rate at which the casing temperature increases from the environment temperature to a maximum temperature threshold, beyond which the compressor will be stopped. Thus, a longer period of operation of the compressor 1 is possible.

There are applications where the compressor is required to operate intermittently, for example in CAES systems. In those systems, the compressor is operated only when an excess of electric power is available on an electric power distribution grid, for example. This typically happens at night time, when the electric power produced by continuously operating, large steam power plants is higher than required by the loads connected to the electric power distribution grid. The excess electric power is converted into mechanical power by an electric motor and then, by means of one or more compressors, into pressure energy of an air flow. The compressed air is stored in a cavern or other storage container. When no power is available from the grid, air is not compressed any further and the compressor 1 can be turned off. The thermal shield described so far reduces the heating rate of the outer casing 3 to such an extent that the temperature of the outer casing 3 will never reach a critical value during the intermittent operation of the compressor.

In other embodiments, where e.g. the compressor can operate continuously, a dual-compressor arrangement can be provided, so that one compressor is operated for a first time interval during which the outer casing 3 slowly achieves a temperature threshold, beyond which the temperature of the casing should not increase. At that point in time, the operating compressor is turned off and the second compressor is started, allowing the first compressor to cool down.

Figure 6:
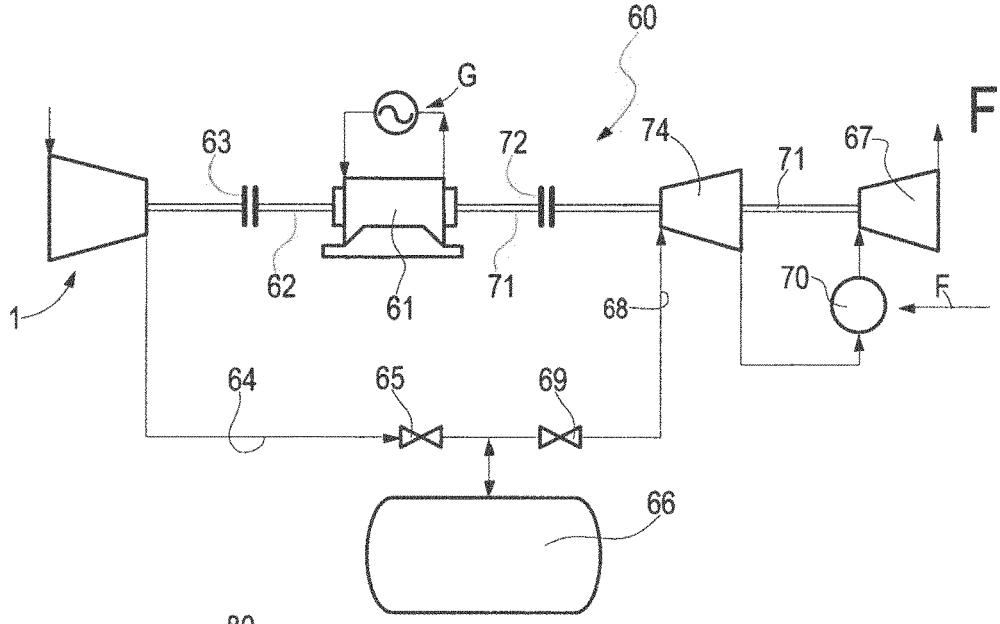
FIG. 6 illustrates a CAES system using a compressor according to the present disclosure.

FIG. 6 illustrates an exemplary embodiment of a CAES system wherein a compressor 1 as described above can be used. The system 60 can be comprised of one or more compressors 1, driven by an electric machine 61. The electric machine 61 can be an electric motor. In some embodiments the electric machine is a reversible electric machine, which can operate alternatively in a motor mode and in a generator mode, which is connected to an electric power distribution grid G.

A shaft 62 connects the electric machine 61 to the compressor 1. A clutch 63 can be arranged between the electric machine 61 and the compressor 1, to selectively connect and disconnect the two machines.

Air ingested by the compressor 1 is compressed and delivered through a duct 64 to a storage container or cavern 66, where compressed air is accumulated. A valve 65 is open when compressed air is delivered by compressor 1 to the cavern 66.

According to some embodiments, the system 60 further comprises an expander 74. A gas turbine 67 can also further be provided. Compressed air can be delivered from the cavern 66 through a duct 68 to the expander 74 and to the gas turbine 67 by opening a valve 69. Partly expanded air delivered by the expander 74 to a combustor 70 can be mixed with a gaseous or liquid fuel F. The air-fuel mixture is ignited to generate combustion gases which are delivered to the gas turbine 67 and expanded therein producing mechanical power available on a shaft 71.

In some embodiments the rotor of the expander 74 can be supported by the same shaft 71 so that mechanical power generated by air expansion in the expander 74 is available on the same driven shaft 71. A clutch 72 can be provided to selectively connect the electric machine 61 to the turbomachines 74 and 67 or disconnect the electric machine 61 therefrom.

The system 60 operates as follows. When a surplus of electric power is available on the electric power distribution grid G, the excess power can be used to run the electric machine 61 in the motor mode and drive the compressor 1. The clutch 63 is engaged and the clutch 72 is disengaged. The turbomachines 74 and 67 are non-operating. The valve 69 is closed and the valve 65 is open. Ambient air ingested by the compressor 1 is compressed and delivered through duct 64 into the cavern 66, where high pressure air is accumulated. This mode of operation continues until an excessive electric power is available from the grid G, for example at night time. The time interval during which the turbocompressor 1 operates is sufficiently short to prevent the outer casing 3 of the compressor 1 from achieving a critical temperature which might cause creep damages to the casing.

When no surplus electric power is available from the grid, the compressor 1 is stopped. If additional electric power is required from the grid G, the system 60 will be turned into the generator mode, by opening the valve 69 and starting the expander 60 and the gas turbine 67. Compressed air is delivered from the cavern 66 towards the expander 74, where it is partly expanded, until the pressure thereof is sufficiently low to enter the combustor 70. Fuel F mixed with the compressed air and ignited generates combustion gases which expand in turbine 67. The clutch 72 is engaged so that the mechanical power generated on shaft 71 can be used to rotate the electric machine 61 which is now operated in the generator mode. The clutch 63 is disengaged. The electric machine 61 thus generates electric power which is injected into the electric power distribution grid G.

Figure 7:
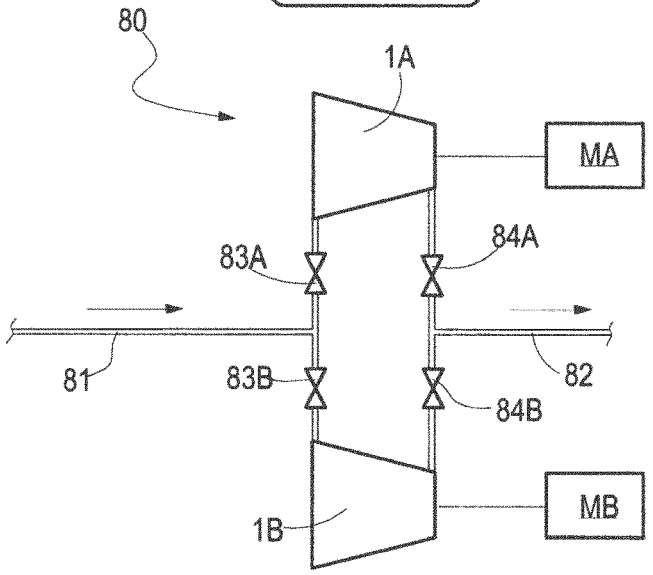
FIG. 7 illustrates a gas processing system using two compressors according to the present disclosure arranged in a tandem configuration.

FIG. 7 illustrates a system wherein two compressors 1 are arranged in parallel and operate alternatively, so that each compressor has a period of cooling, when the outer casing thereof has reached a temperature threshold, ensuring a continuous operation of the system, preventing the compressor casings from heating beyond a critical temperature, which can cause creeping phenomena. In some embodiments the system is comprised of a first compressor 1A and a second compressor a1B. The compressors 1A and 1B can be designed as disclosed in connection with FIGS. 1 through 5. Each compressor 1A and 1B can be driven by its own electric motor MA and MB respectively. Other prime movers such as a turbine can be used instead of an electric motor.

An inlet pipeline 81 supplies gas to be compressed to either one or the other of the two compressors 1A and 1B. A delivery pipeline 82 receives the compressed gas from either one or the other of the two compressors 1A and 1B. Valves 83A and 83B at the gas inlets of the two compressors 1A, 1B and valves 84A and 84B at the outlet of the two compressors 1A and 1B can be used to selectively connect one or the other of the two compressors 1A and 1B to the pipeline systems 81 and 82.

The operation of the system 80 is as follows. The compressor 1A can operate for example for a first time interval, during which the outer casing thereof slowly heats up due to the heat flow from the processed gas. The thermal shielding arrangements provided in the interior of the compressor slow the heating of the casing. When a temperature threshold is reached, or after a pre-set time interval has lapsed, the second compressor 1B is started and the first compressor 1A can be stopped. In this manner the first compressor 1A is allowed to cool down to the ambient temperature, while the second compressor 1B is operating and slowly heats up.

Figure 8:
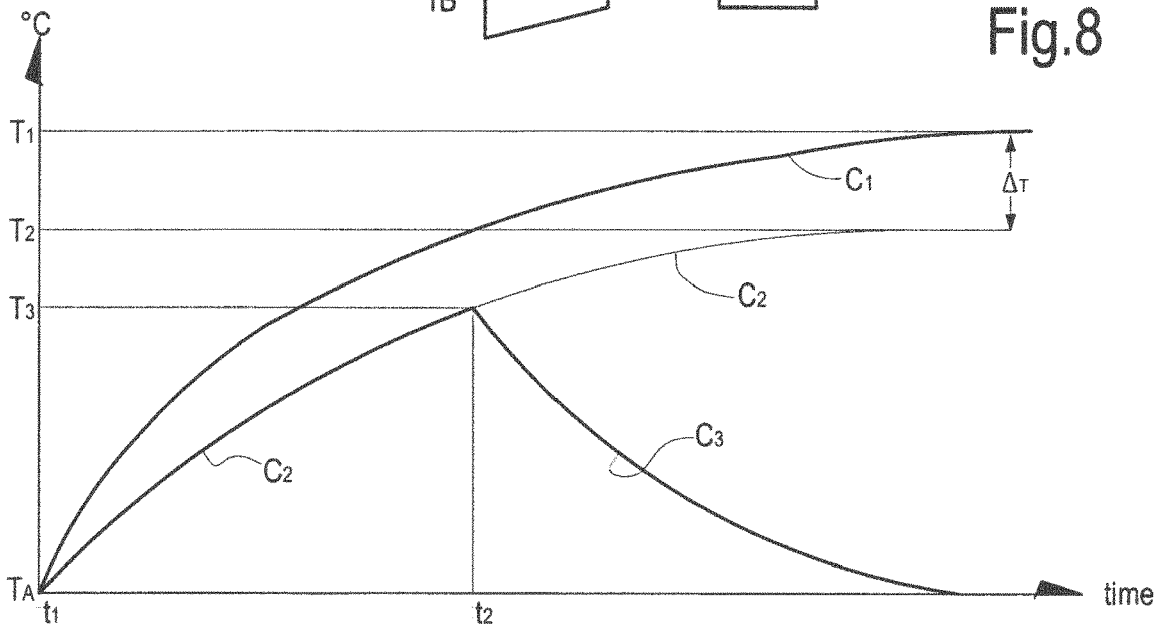
FIG. 8 illustrates a temperature-vs.-time diagram.

FIG. 8 schematically illustrates an exemplary and schematic representation of the casing temperature versus time in the case of a compressor of the current art (curve C1) and of a compressor according to the present disclosure (curves C2 and C3). The first curve C1 illustrates the temperature increase from the ambient temperature up to a maximum value T1, which is asymptotically reached after a certain time interval.

If a thermal shield arrangement as disclosed above is used, the temperature of the casing 3 will increase according to curve C2. The temperature increase along curve C2 is substantially slower than the temperature increase along curve C1. This is due to the thermal barrier effect given by the thermal shield arrangement. Moreover, the maximum temperature T2 achieved by the outer casing will be in this case lower than the temperature T1 achieved by a state of the art compressor. The maximum temperature difference is indicated as $\Delta T$.

In actual fact, in some embodiments, as noted above, in order to further preserve the outer casing from creep damages the compressor 1 can be run for a time interval, after which the compressor is stopped and allowed to cool down. This mode of operating the compressor is shown by curves C2 and C3. For example, the compressor can be operated until the outer casing thereof achieves a temperature T3 after a time interval t2-t1. At time t2 the compressor is stopped and the temperature of the outer casing 3 thereof will decrease along curve C3 until reaching the ambient temperature TA.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions.

In addition, the order or sequence of any process or method steps may be varied or re-sequenced according to alternative embodiments.

What is claimed is:

1. A gas compressor comprising:

a casing with a gas inlet and a gas outlet;

a compressor bundle arranged in the casing;

a thermal shield arranged between the compressor bundle and the casing and configured to reduce heat transfer from a gas flow processed through the gas compressor to the casing;

a discharge duct comprising a thermal insulating arrangement configured to reduce heat transfer from the gas flow to an inner surface of the discharge duct;

a volute configured to collect and deliver a compressed gas towards the gas outlet; and at least a first thermal shield arranged between the volute and the casing.

2. The gas compressor of claim 1, wherein the thermal insulating arrangement comprises a liner and a thermally insulating cladding arranged between the liner and the inner surface of the discharge duct.

3. The gas compressor according to claim 1, wherein the at least a first thermal shield comprises a ceramic material.

4. The gas compressor of claim 3, wherein said ceramic material is selected from the group consisting of: steatite, cordierite, alumina, zirconia, or combinations thereof.

5. The gas compressor according to claim 1, wherein the thermal insulating arrangement comprises a ceramic material.

6. The gas compressor according to claim 1, wherein the at least a first thermal shield comprises at least one insulation plate comprised of an outer sheet and an inner thermally insulating material.

7. The gas compressor according to claim 6, wherein said outer sheet is constrained to the casing.

8. The gas compressor according to claim 6, wherein said outer sheet is a metal sheet.

9. The gas compressor according to claim 1, wherein the thermal insulating arrangement comprises at least one insulation plate comprised of an outer sheet and an inner thermally insulating material.

10. The gas compressor according to claim 1, wherein the at least a first thermal shield is at least partly formed by deposition on a surface of the casing and/or of the compressor bundle and/or of the volute.

11. The gas compressor according to claim 10, wherein said deposition is by thermal spray, or plasma spray, or electro-chemical deposition, or a combination thereof.

12. The gas compressor according to claim 1, wherein said thermal insulating arrangement comprises a deposition of thermally insulating material on the inner surface of the discharge duct.

13. A compressor system comprising at least a first compressor and a second compressor according to claim 12, wherein said first compressor and said second compressor operate alternatively such that when one of said first compressor and said second compressor is operating the other of said first compressor and said second compressor is allowed to cool.

14. A compressor system comprising at least a first compressor and a second compressor according to claim 1, wherein said first compressor and said second compressor operate alternatively such that when one of said first compressor and said second compressor is operating the other of said first compressor and said second compressor is allowed to cool.

15. A method of operating a gas compressor comprising a compressor bundle arranged in a casing, a gas collecting volute and a gas discharge duct, the method comprising:

receiving a gaseous flow through the compressor;

reducing heat transfer from the gaseous flow toward the casing via at least a first thermal shield arranged between the compressor bundle and the casing;

reducing heat transfer from the gaseous flow to a side wall of the discharge duct via a thermal insulating arrangement inside the gas discharge duct; and reducing heat transfer from the gas collecting volute to the casing via at least a second thermal shield arranged between the gas collecting volute and the casing.

* * * * *